US005860858A

United States Patent [19]

Wettergren

[11] Patent Number: 5,860,858

[45] Date of Patent: Jan. 19, 1999

[54] AIR DUCT BOOSTER FAN AND CONTROL DEVICE THEREFOR

[76] Inventor: Ola Wettergren, 1712 Northgate Blvd., Sarasota, Fla. 34234

[21] Appl. No.: 995,314

[22] Filed: Dec. 22, 1997

[51] Int. Cl.[6] ..... F23L 17/00

[52] U.S. Cl. ..... 454/343; 34/235; 454/16

[58] Field of Search ..... 454/16, 329, 343; 34/235; 126/299 R, 299 D

[56] References Cited

U.S. PATENT DOCUMENTS

| | | | |
|---|---|---|---|
| 3,099,201 | 7/1963 | Gotlieb . | |
| 4,352,453 | 10/1982 | McNabney . | |
| 4,576,331 | 3/1986 | Harwell . | |
| 4,589,331 | 5/1986 | Villamagna et al. | 454/329 X |
| 5,209,697 | 5/1993 | Hurst et al. | 126/299 D X |

FOREIGN PATENT DOCUMENTS

| | | | |
|---|---|---|---|
| 418748 | 10/1934 | United Kingdom | 454/343 |

*Primary Examiner*—Harold Joyce
*Attorney, Agent, or Firm*—Charles J. Prescott

[57] ABSTRACT

An airflow booster fan and control device therefor, the booster fan, preferably of the centrifugal, axial flow type, adapted for in-line installation into a length of duct or at the remotely located end of the duct in an air transfer duct system. The duct system may be one which removes heated and moistened air from a clothes dryer and particularly where the duct system is remotely located from the dryer. The control device delivers electrical power to the booster fan when an air pressure signal from within the duct system in close proximity to, or within, the booster fan is sufficient, as indicative of e.g. clothes dryer operation, to activate the control device to do so. However, a time delay relay in the control device maintains the booster fan in operation after each activating pressure signal for a predetermined length of time, after which the booster fan will be shut off. If there is still air pressure buildup in the duct system, the booster fan will be reactivated for another time to shut off delay period. The control device may be mounted directly to the booster fan housing or to adjacent or remote building support structure, the only requirement therebetween being the interconnection of electric power transfer cable between an electric power outlet and the control device and between the control device and the booster fan, as well as an air pressure transfer conduit from the booster fan or adjacent duct and the control device.

3 Claims, 1 Drawing Sheet

AIR DUCT BOOSTER FAN AND CONTROL DEVICE THEREFOR

BACKGROUND OF THE INVENTION

1. Scope of Invention

This invention relates generally to booster fans for airflow duct systems, and more particularly to an in-line booster fan for such duct systems which is fully automatically controlled by air duct operating conditions.

2. Prior Art

When there is a need for boosting or increasing the air flow within a duct system such as that associated with the removal of heated and moistened air discharging or venting from a clothes dryer, an axial flow booster fan is generally added somewhere along the length of the duct system. Such booster fan installations are typically required where the outlet vent or discharge for the duct system is remotely located from the clothes dryer or other vented appliance or equipment which discharges air for removal.

However, the booster fan is only needed and therefore ideally should only operate during the time periods of clothes dryer operation. In many cases however, it is impractical to control the operation of the booster fan using the electrical power supply from the appliance because of the remoteness between the booster fan and the appliance. Further, it is generally impractical to control the operation of the booster fan with conventional manually operated electric switches, again due to the remoteness of the booster fan location.

It is well known to utilize pressure differential sensors between the inside and the outside of the duct system or axial flow booster fan. Such a pressure switch which measures static or total pressure and may be triggered by either a positive or a negative pressure differential to accomplish this booster fan operation control. Such increased duct system static pressure occurs when the appliance begins to operate, causing the static pressure buildup in the duct system. However, erratic and undesirable operation is likely to result.

If the pressure sensor is located in one section of the duct system, the pressure change as a result of the booster fan operation may cause the pressure switch to open, prematurely shutting off the booster fan. Thereafter, the pressure switch will again close, restarting the booster fan. This undesirable on-off cycling of the booster fan continues until the appliance itself shuts off.

If the pressure switch is located in another section of the duct system, the booster fan will amplify the pressure differential, causing the pressure switch to remain closed, even when the appliance shuts off and its airflow into the duct system is discontinued.

With great care, the pressure sensing arrangement may be located in conjunction with the pressure buildup of each individual booster fan so as to timely energize and shut off the operation of the booster fan generally coincident with the operation of the appliance requiring system ventilation. However, this is a time-consuming and tedious procedure, requiring a higher level of technical competence in the installation.

The present invention utilizes the pressure sensing features which is indicative of appliance operation, but couples this pressure signal input to energize the booster fan with a predetermined time delay for shutting the blower fan off, e.g. about five to twenty minutes. Thus, no matter what pressure signal is used by the control device of the present invention, the booster fan will remain operational for the predetermined time period after which it will be shut off by the timed delay relay. Subsequent booster fan reactivation will occur each time pressure buildup in the duct system in close proximity to the booster fan reoccurs.

BRIEF SUMMARY OF THE INVENTION

This invention is directed to a booster fan, preferably of the centrifugal, axial flow type, and control device therefor, the booster fan adapted for in-line installation into a length or terminal end of duct in an air transfer duct system. The duct system may be one which removes heated and moistened air from a clothes dryer and particularly where the duct system is remotely located from the dryer. The control device makes the booster operational when an air pressure signal from within the duct system in close proximity to, or within, the booster fan is sufficient, as indicative of e.g. clothes dryer operation, to activate the control device to do so. However, a time delay relay in the control device maintains the booster fan in operation after each activating pressure signal for a predetermined length of time, after which the booster fan will be shut off. If there is still air pressure buildup in the duct system, the booster fan will be reactivated for another time to shut off delay period.

It is therefore an object of this invention to provide a booster fan and control device which will timely operate in response to a pressure signal which indicates that an appliance or ventilation system of an appliance such as a clothes dryer is operational and which will both avoid prolonged periods of unnecessary booster fan operation or erratic cyclic rapid on-off operation thereof during each appliance operational cycle.

It is another object of this invention to provide an easily installable booster fan and control device which may be installed anywhere along the length of an air duct system which removes air vented from an appliance without the need for direct electrical or physical connection with the appliance.

In accordance with these and other objects which will become apparent hereinafter, the instant invention will now be described with reference to the accompanying drawings.

DETAILED DESCRIPTION OF THE INVENTION

Figure 1:
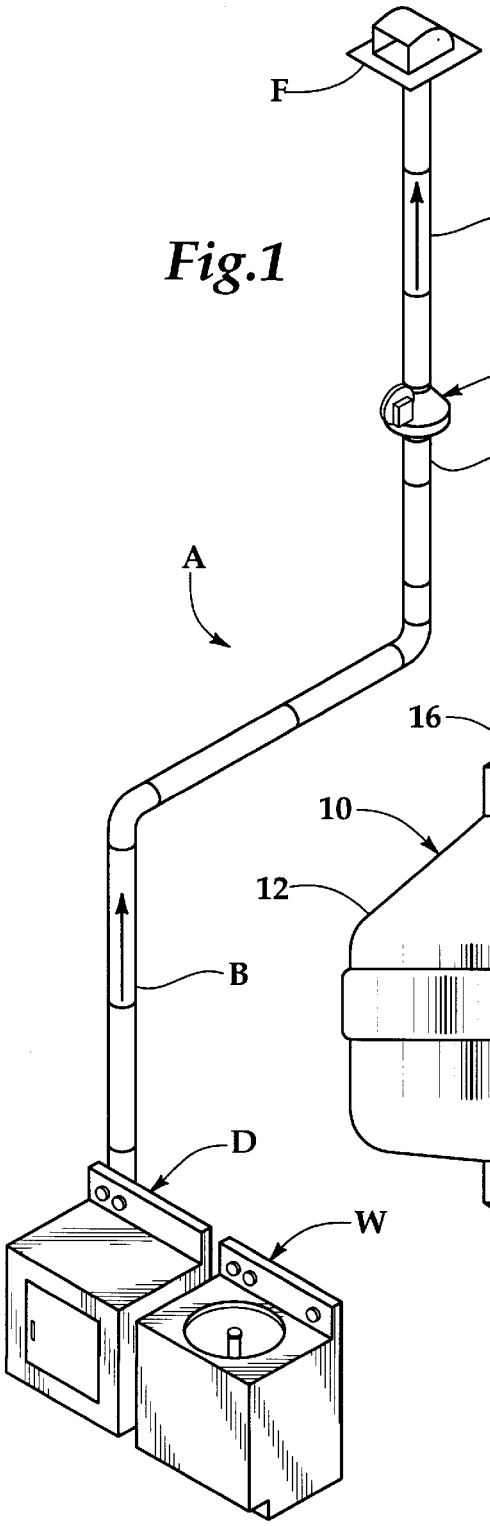
FIG. 1 is a perspective view of the invention installed into the inner duct system of a clothes dryer.

The present invention discloses a booster fan or its equivalent, such as the preferred axial flow type, and a control device associated therewith which may be mounted directly onto the booster fan housing or positioned adjacent thereto or remotely from the booster fan and receiving support from adjacent building or duct work structure. As shown in FIG. 1, the preferred application of the invention shown generally at numeral 10 is in conjunction with a duct system shown generally at A for venting the moistened and heated air which is vented from a clothes dryer D. Typically, the clothes dryer D is positioned adjacent the clothes washer W which is net included or intended to be a part of this preferred system.

The duct system A typically includes tubular light weight duct segments shown typically at B and E. A vent F remotely located from the clothes dryer D such as on a roof or through an upper wall area properly discharges the airflow according to building design. The clothes dryer D includes an internal means for venting this heated and moistened air with some limited force and velocity which is typically inadequate for duct system installation situations such as the one shorten in FIG. 1 wherein the discharge vent F is remotely located and connected to the clothes dryer D through a considerable length of duct members B and E.

Figure 2:
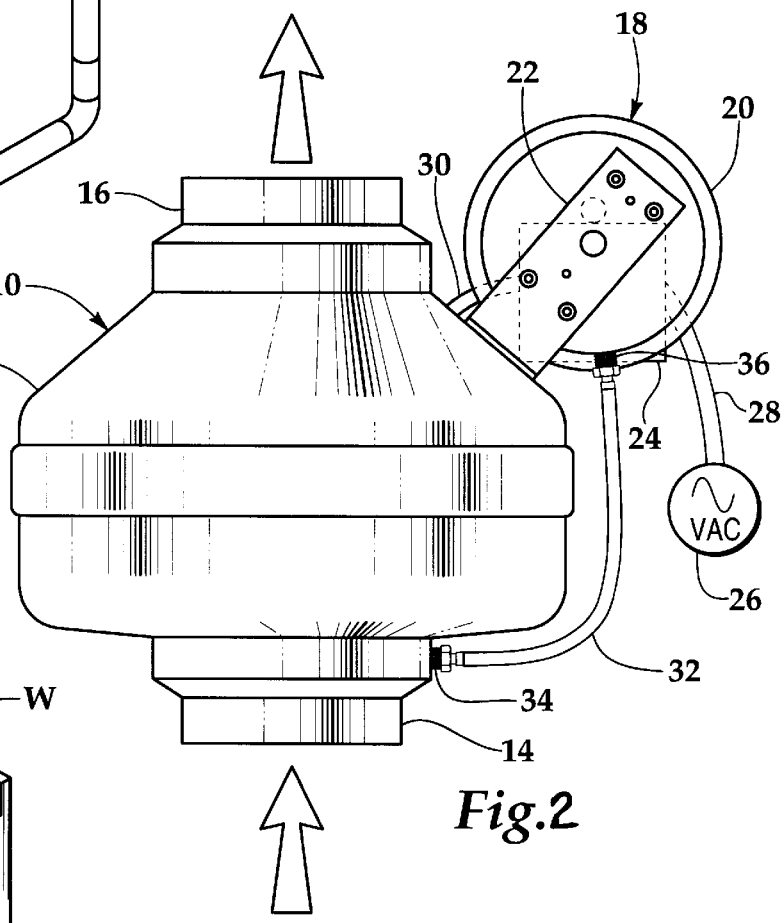
FIG. 2 is a side elevation view of the invention of FIG. 1.

A unique feature of the present invention is that the entire unit 10 may be located within the duct system A at a location remote from the clothes dryer D as desired and as most easily accessible for installation. As best seen in FIG. 2, the device 10 includes a molded plastic housing 12 having axially aligned inlet 14 and outlet 16 whereby the motor and fan mechanism internal to the housing 12 (not shown) produce axial airflow therethrough in the direction of the arrows.

The control device is shown generally at numeral 18 and includes a pressure responsive switch 20 and a time delay to shut-off relay 24. The air pressure responsive switch 20 includes a static air pressure inlet 36 which is interconnected by a flexible tube 32 to a pressure cap 34 disposed in the inlet 14 of the booster fan 10. The time delay relay 24 is electrically connected by wiring 24 to a source of a.c. voltage 26. Electrical power is conveyed, when made available, from the relay 24 by wiring 30 into the motor (not shown) of the booster fan 10. The control device 18 is mounted by bracket 22 directly to housing 12. However, the control device 18 may also be located adjacent to, or remote from, the booster fan 10 attached to adjacent building and air duct structure as desired. The booster fan may also be located at a terminal end of the air duct structure such as a roof-mounted or outside wall-mounted booster fan within an appropriate exterior housing.

When the clothes dryer D or other ventilated appliance is operational, airflow commences in the direction of the arrows through the duct system A. This dryer operation quickly produces a static pressure air build-up throughout the duct system A and including duct member C which is connected to inlet 14. When the air pressure build-up within inlet 14 at outlet 34 is sufficient, the pressure switch 20 provides a signal to relay 24 which then triggers a relay to provide electrical power into the motor (not shown) of the booster fan 10. Internal to the relay 24, a time delay sequence is initiated upon the receipt of static air pressure sufficient to initially interconnect electrical power to the motor (not shown) to the booster fan 10. This time delay period is typically about ten minutes, although may be easily varied from five to twenty minutes or beyond as desired. This time delay causes the electrical power into the booster fan 10 to be continuous for the delay period, regardless of whether the air pressure at 34 is maintained at a predetermined triggering level.

At the end of the predetermined time delay period, electrical power will be interrupted to the booster fan 10 at that time, if air pressure within the air duct system A is at ambient air pressure, meaning that the clothes dryer D has discontinued operation, this control device 18 will remain idle until such time as the clothes dryer D is put into operation again, causing a static air pressure within the duct system A to re-energize the control device 18 and booster fan 10 as previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An automatically controlled air duct airflow booster fan for an air duct system comprising:

a fan housing including substantially axially aligned air inlet and outlet operably connectable into a length of air duct and an electric motor operably connected to an internal air impeller operably mounted within said housing whereby, when said booster fan is operated, airflow through the air duct is increased;

control means electrically connected to an electric power supply and to said electric motor and pneumatically connected to said inlet whereby said control means receives an air pressure signal when air pressure is within said inlet which causes an electrical connection to be made between the electric power supply and said electric motor;

time delay means operably connected to said control means for maintaining the electrical connection between the electric power supply and said electric motor for a predetermined length of time after the electrical connection is made regardless of whether the air pressure signal into said control means remains.

2. A control device for an air duct booster fan which operates to increase airflow through a length of duct into which an inlet and an outlet of the booster fan is operably connected, said control device comprising:

electrical connection means positioned electrically between the booster fan and an electric power supply and also having a pressure relay pneumatically connected for receiving a pressure signal from an inlet of the booster fan whereby an initial electrical connection is made between the electric power supply and the booster fan when there is sufficient air pressure in the inlet;

time delay means operably connected to said electrical connection means for maintaining the electrical connection between the electric power supply and the booster fan for a predetermined length of time after each initial electrical connection is made.

3. In an air duct system for conveying air away from an appliance which discharges air therefrom to a remote outlet of said system, the improvement comprising:

an air duct airflow booster fan comprising:

a fan housing including an air inlet and an air outlet connectable in axial airflow fashion into a length of air duct and an electric motor operably connected to an internal air impeller operably mounted within said housing whereby, when said booster fan is operated, airflow through the air duct is increased;

control means electrically connected to an electric power supply and to said electric motor and pneumatically connected to said inlet whereby said control means receives an air pressure signal when sufficient air pressure is present within or in close proximity to said inlet which causes an initial electrical connection to be made between the electric power supply and said electric motor each time there is sufficient air pressure in said inlet;

time delay means operably connected to said control means for maintaining the electrical connection between the electric power supply and said electric motor for a predetermined length of time after the initial electrical connection is made regardless of whether the air pressure signal into said control means becomes insufficient to otherwise maintain the electrical connection.

* * * * *